US007998039B1

(12) United States Patent
Wallach

(10) Patent No.: US 7,998,039 B1
(45) Date of Patent: Aug. 16, 2011

(54) ABDOMINAL EXERCISE DEVICE

(76) Inventor: Mark Wallach, San Juan Capistrano, CA (US)

( * ) Notice: Subject to any disclaimer, the term of this patent is extended or adjusted under 35 U.S.C. 154(b) by 0 days.

(21) Appl. No.: 12/661,179

(22) Filed: Mar. 10, 2010

(51) Int. Cl.
*A63B 21/02* (2006.01)

(52) U.S. Cl. ..... 482/121

(58) Field of Classification Search ..... 482/121–133, 482/148, 140, 91, 907, 139, 92, 51
See application file for complete search history.

(56) References Cited

U.S. PATENT DOCUMENTS

| | | | | |
|---|---|---|---|---|
| 3,787,049 | A * | 1/1974 | Rellinger | 482/142 |
| 4,609,193 | A | 9/1986 | Paris et al. | |
| 5,217,487 | A * | 6/1993 | Engel et al. | 606/240 |
| 5,913,758 | A * | 6/1999 | Nunez | 482/142 |
| 5,931,769 | A * | 8/1999 | Nunez | 482/142 |
| 6,106,490 | A | 8/2000 | Shaw | |
| 6,258,012 | B1 * | 7/2001 | Yoshimura | 482/52 |
| 6,309,330 | B1 | 10/2001 | Thornton | |
| 6,752,745 | B1 * | 6/2004 | Davis | 482/72 |
| 7,160,233 | B2 | 1/2007 | Perez | |
| 7,488,281 | B2 | 2/2009 | Weir et al. | |
| 7,563,215 | B1 | 7/2009 | Ross, Jr. | |
| 2002/0173412 | A1 * | 11/2002 | Stearns | 482/123 |
| 2003/0130100 | A1 | 7/2003 | Perez | |
| 2004/0063555 | A1 | 4/2004 | Perez | |
| 2005/0187084 | A1 | 8/2005 | Tornabene | |
| 2005/0227835 | A1 | 10/2005 | Hazan | |
| 2008/0096743 | A1 | 4/2008 | Weir et al. | |
| 2008/0254957 | A1 | 10/2008 | Hazan et al. | |

* cited by examiner

*Primary Examiner* — Lori Baker
(74) *Attorney, Agent, or Firm* — Jones Day

(57) ABSTRACT

An abdominal exercise device comprising a seat back pivotally attached to a base that includes a foot plate, wherein a spring or other resistive element is attached between the seat back and the base, which is capable of simultaneously exercising a plurality of muscle groups while standing, in a hands-free manner. While the user is standing on the foot plate, abdominal and other muscles are exercised when the user presses in a backward direction against the seat back, and then releases the pressure on the seat back such that the seat back returns to an upright or near upright position. The exercise device includes the capability of tension adjustment on the seat back, such that more or less force can be applied to cause the seat back to move in a backward direction.

16 Claims, 4 Drawing Sheets

ABDOMINAL EXERCISE DEVICE

BACKGROUND OF THE INVENTION

The field of the present invention is exercise devices, specifically, an improved, abdominal exercise device capable of simultaneously and effectively exercising a plurality of muscle groups.

Devices that function to exercise various muscle groups are well-known in the art. In particular, stationary abdominal exercise devices have been described previously. See, e.g., Thornton (U.S. Pat. No. 6,309,330 B1); and Ross (U.S. Pat. No. 7,563,215 B1). In general, such devices permit a user to exercise certain muscle groups by moving his or her body while the device acts as a support for the user, though the device itself generally is static or remains relatively stationary while the user performs the exercise routine. Non-static abdominal exercise devices also have been described previously. See, e.g., Perez (U.S. Pat. No. 7,160,233 B2); Weir, et al. (U.S. Pat. No. 7,488,281 B2); Perez (U.S. Patent Application Publication No. US 2003/0130100 A1); and Hazan, et al. (U.S. Patent Application Publication No. US 2008/0254957 A1). In general, these devices permit a user to exercise certain muscle groups using a device that moves in response to input from the user while the user is in an inclined or seated position.

The devices disclosed in the prior art fail to achieve an effective design wherein the user can stand while engaging a non-static, resistive device in order to perform hands-free, abdominal exercises in a comfortable and efficient manner. Standing while performing abdominal exercises is efficient as it augments the user's cardiovascular fitness, and it allows for exercise of the user's leg muscles. Hazan, et al. (U.S. Patent Application Publication No. US 2008/0254957 A1) purports to describe a device that operates while the user is in a standing position, though use of the device in the manner disclosed may be cumbersome as the user must engage his or her abdominal region against a narrow bar. In addition, while some of the devices disclosed in the prior art consist of designs that may permit exercise of the abdominal muscles, they possess further limitations and drawbacks, including but not limited to lack of ease of transition between exercises, lack of comfort or ease of use, lack of a specific resistance element for abdominal exercises, lack of adequate or proper back support, lack of means to adjust the device to a particular user, and/or limited range of motion. Moreover, some of the devices require that the user hold fast to handles during exercise movements, thus impeding the user's ability to use his or her hands to perform other activities while using the device, such as exercising while holding weights, bar bells, or other similar devices. Other limitations and drawbacks of the devices disclosed in the prior art will be apparent to one of skill in the art.

SUMMARY OF THE PRESENT INVENTION

In view of the foregoing disadvantages and problems inherent in the devices disclosed in the prior art, the present invention is an improved abdominal exercise device that permits an adjustable, hands-free, comfortable, and efficient workout of the abdominal muscles, including other core muscles such as the oblique and lumbar muscles, while doing so generally in a standing position without the use of a seat or other similar support mechanism.

As will be described in greater detail below, the present invention accomplishes the foregoing using a resistance-based system, comprising a pivoting seat back fitted atop a support frame, wherein the seat back is resistively-connected to the support frame. When the user's back is pressed against the seat back and sufficient force is applied, the seat back pivots in a backwards direction. Once the user's desired range of backward motion is achieved, the user decreases or releases backward pressure in order to move forward and return to the starting position, and the user then can repeat this cycle. The user's abdominal and other core muscles, as well as the user's leg muscles, are exercised during each cycle.

The foregoing description, objects, and advantages of the present invention are not meant to be an exhaustive summary, inasmuch as additional pertinent aspects of this invention will be readily apparent to those skilled in the art from the following detailed description, taken independently or in conjunction with the annexed sheets of drawings, in which one or more embodiments of the invention are described and shown. The following detailed description and annexed drawings are provided only for purposes of illustration of certain specific embodiments of the present invention, and not for purposes of limitation of the appended claims.

BRIEF DESCRIPTION OF THE DRAWINGS

The following detailed description of the invention can be better understood with reference to the accompanying drawings, wherein.

In the drawings, similar reference characters denote similar elements throughout the several views, as well as within the detailed description below.

DETAILED DESCRIPTION OF A PREFERRED EMBODIMENT

The following detailed description is not meant to limit the instant claimed invention, inasmuch as alternate embodiments will be readily apparent to those skilled in the art.

Referring to FIGS. 1-4, an abdominal exercise device is shown in accordance with the present invention.

Figure 1:
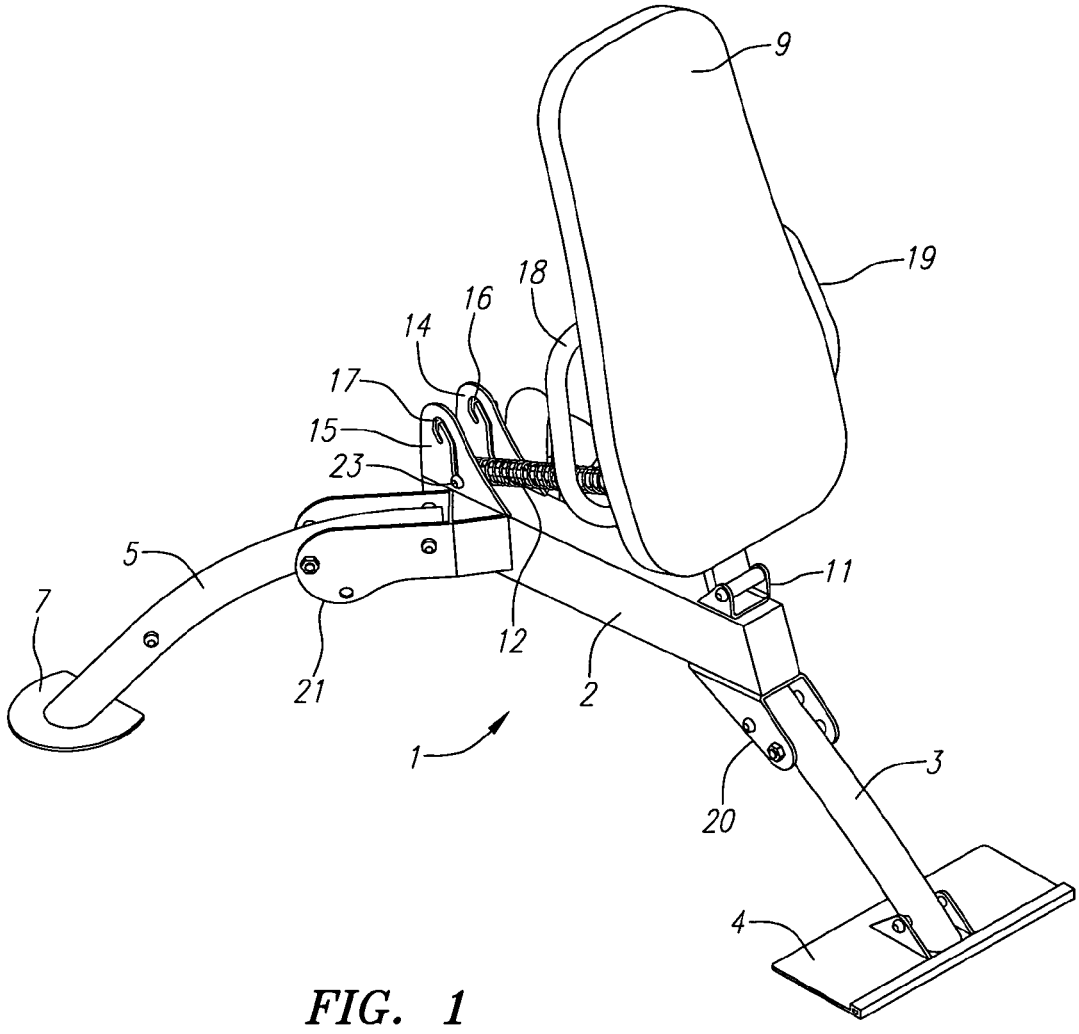
FIG. 1 is a front, perspective view of the exercise device in accordance with the present invention, showing the various exercise components of the device in a static position.
Figure 2:
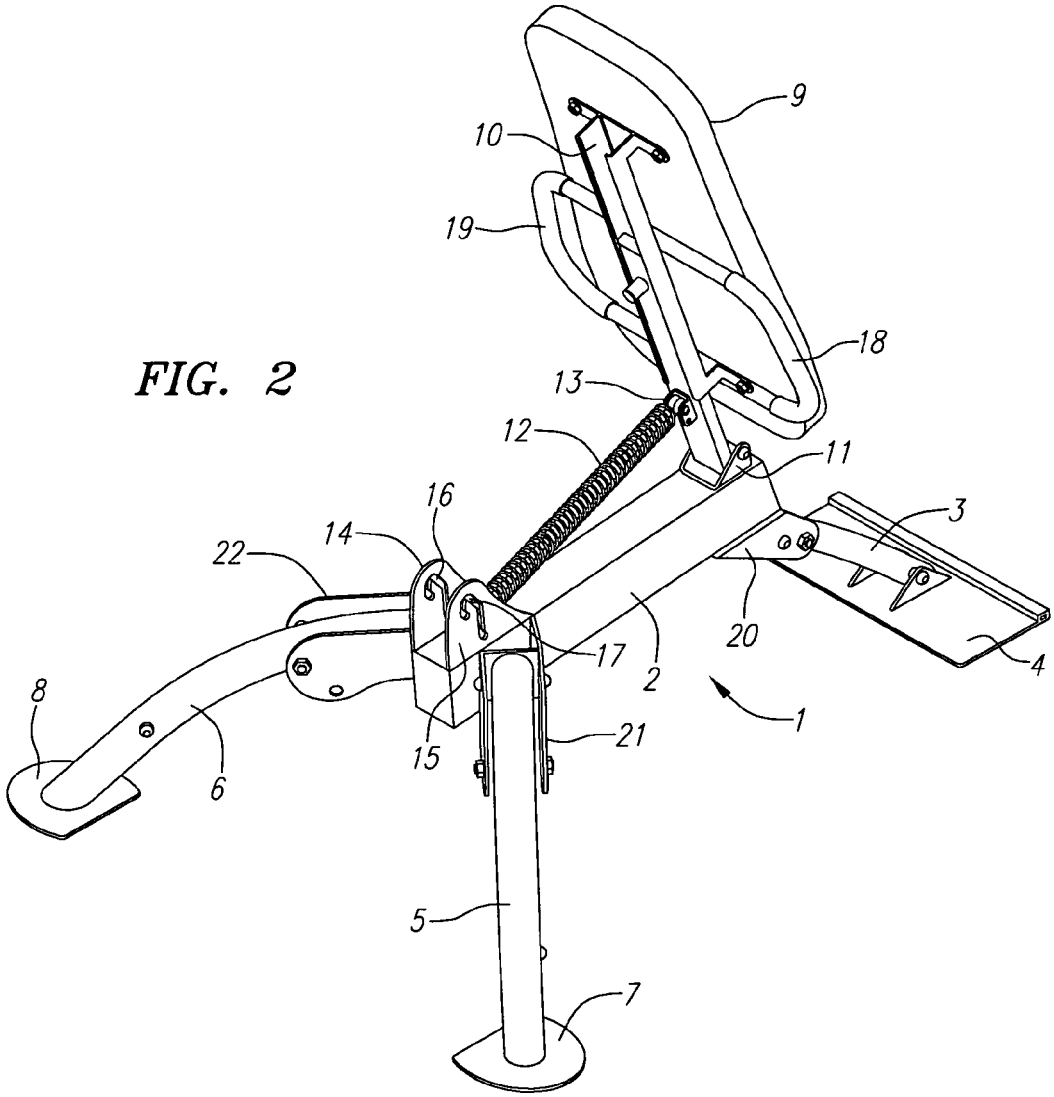
FIG. 2 is a rear, perspective view of the exercise device in accordance with the present invention, showing the various exercise components of the device in a static position.

Referring to FIGS. 1 and 2, the invention includes base 1, which is comprised of longitudinal bar 2, to which is attached front leg 3 that rests on foot plate 4, and back legs 5 and 6 that rest on flat plates 7 and 8, respectively. Front leg 3 is attached to longitudinal bar 2 by way of bracket 20, and back legs 5 and 6 are attached to longitudinal bar 2 by way of brackets 21 and 22, respectively. Seat back 9 is attached to vertical bar 10, which itself is attached to the top, forward portion of longitudinal bar 2 by way of hinge 11, and accordingly, seat back 9 is capable of forward and backwards motion inasmuch as vertical bar 10 is capable of pivoting backwards and forwards across hinge 11. Handles 18 and 19 may be attached to seat back 9, or alternatively, may be attached to vertical bar 10.

Referring to FIGS. 1 and 2, the forward end of spring 12 is attached near the back, lower portion of vertical bar 10 by way of small hinge 13. The rear end of spring 12 is attached to longitudinal bar 2 by way of slotted fixtures 14 and 15, which include curved slots 16 and 17, respectively. Pin 23 is fitted transversely through the rear end of spring 12 and curved slots 16 and 17, such that a small portion of each end of pin 23 protrudes through slots 16 and 17, thus holding spring 12 in place between slotted fixtures 14 and 15. While a spring is shown as a possible resistive element, persons of skill in the art will readily appreciate that many other possible resistive elements may be used, including but not limited to rubber, polymeric, or other elastic materials, pneumatic or hydraulic arms, pumps, or piston/cylinder devices, or other similar materials or devices.

Figure 3:
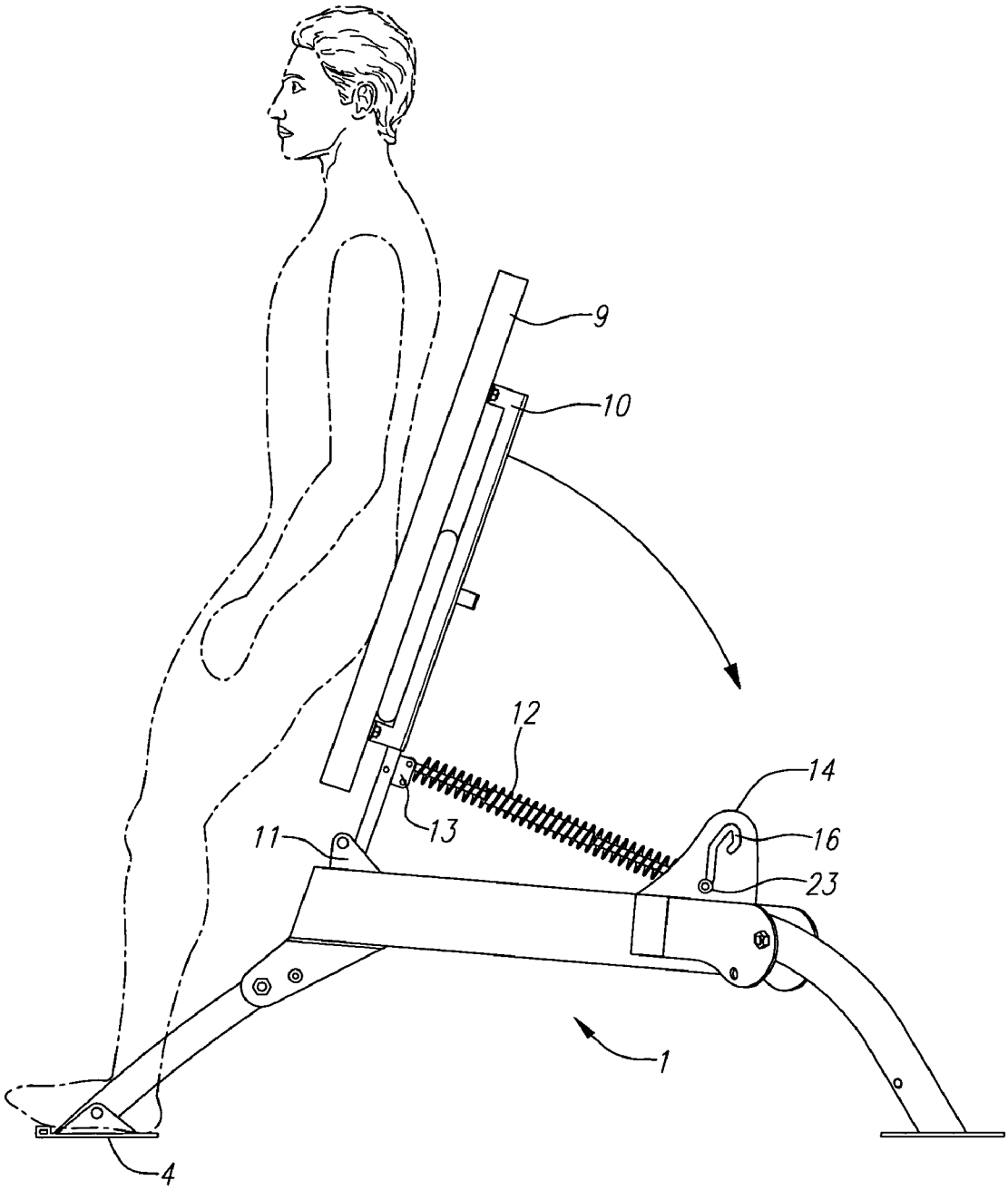
FIG. 3 is a side view of the exercise device in accordance with the present invention, showing the various exercise components of the device in a static position, and depicting a user of the device in the starting position.

Referring to FIG. 3, in operation, the user begins in the starting position by standing on foot plate 4 and positioning the user's back in front of, and against seat back 9. Seat back 9 is meant to tilt in a backwards direction as shown by the arrow.

Figure 4:
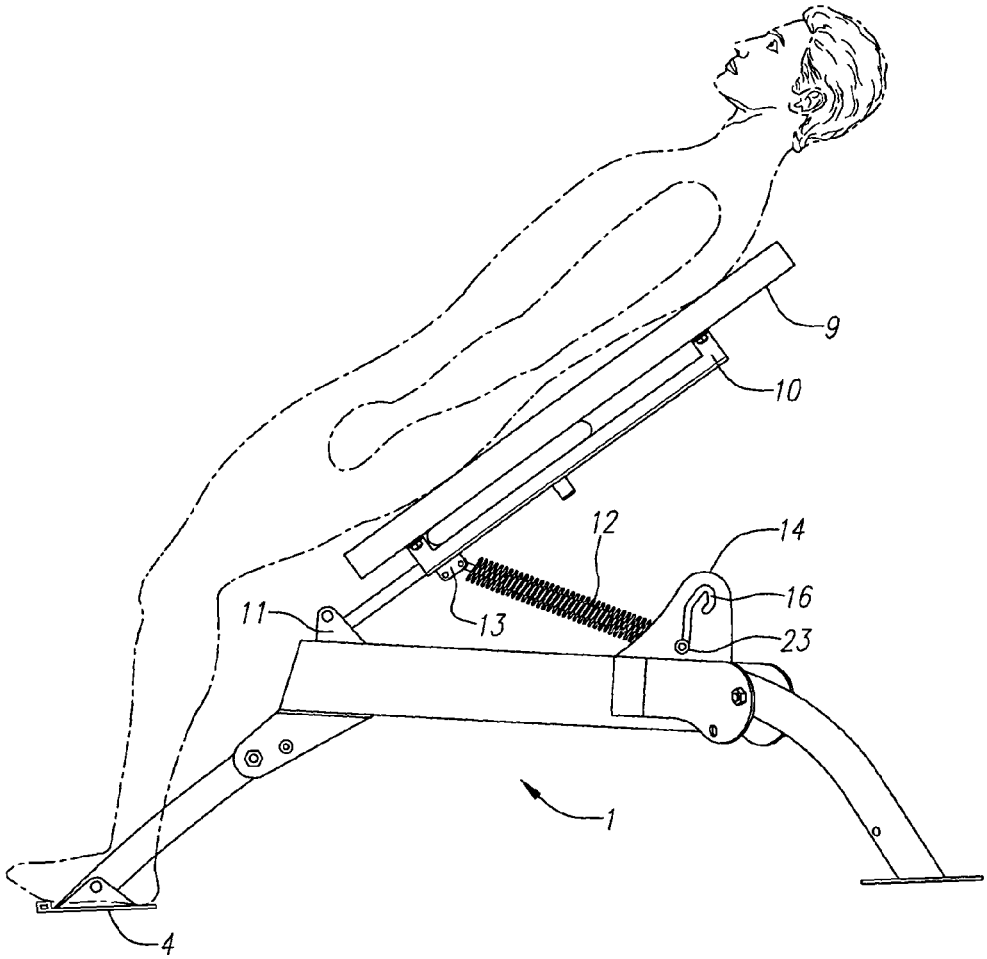
FIG. 4 is a side view of the exercise device in accordance with the present invention, showing the various exercise components of the device, and depicting a user engaging the device.

Referring to FIG. 4, the user presses against seat back 9, which causes the user to tilt, along with seat back 9, in a backwards direction, which concurrently causes vertical bar 10 to pivot about hinge 11, and concurrently causes spring 12 to compress (and move about small hinge 13 and pin 23) and exert resistive forces opposing the user's backward movement. Once the user has moved backward through the desired range, the user decreases the backwards force he or she is applying such that the seat back moves forward until it and the user have reached the starting position shown in FIG. 3. The user is able to achieve an effective workout by repeating this cycle.

The force that spring 12 exerts during exercise motion can be modified by moving pin 23 about slots 16 and 17 to a higher or lower position. Because the user can use the device in a hands-free manner, the user's hands are available such that the user can perform other exercises while using the device, such as using hand weights, bar bells, or other similar devices. Though not required during normal operation, if desired, the user can perform the above-referenced exercise cycle by holding on to handles 18 and 19 for support while exercising.

Although a particular embodiment of the invention has been described and illustrated herein in detail, it is recognized that modifications of many aspects of this device may readily occur and be achieved by those skilled in the art. Consequently, it is intended that the claims herein be interpreted to cover any such modifications. It is further intended that the present invention be not limited according to the disclosed embodiment, but rather only according to the appended claims.

What is claimed is:

1. An exercise device consisting essentially of:

a base, said base having a front end and a rear end;

a seat back having a top end and a bottom end, wherein said seat back is attached with a hinge to said base proximate the front end of said base and proximate the bottom end of said seat back, said base including a foot plate attached to said base proximate the lower front portion of said base;

a resistive element having a front end and a rear end, wherein the front end of said resistive element is attached proximate the bottom end of said seat back, and the rear end of said resistive element is attached proximate the rear end of said base, said resistive element adapted to allow backward pivoting movement of said seat back about said hinge when a user stands on said foot plate and presses in a backward direction against said seat back, said resistive element further adapted to provide substantially immediate and constant resistance upon movement of said seat back.

2. The exercise device according to claim 1, further comprising a resistive element adapted to allow forward pivoting movement of said seat back about said hinge after a uses presses in a backward direction against said seat back, and after said seat back has moved in a backward direction.

3. The exercise device according to claim 1, further comprising a resistive element adapted to increase its span between said seat back and said base.

4. The exercise device according to claim 1, further comprising a resistive element adapted to decrease its span between said seat back and said base.

5. The exercise device according to claim 3, further comprising a resistive element adapted to decrease its span between said seat back and said base.

6. The exercise device according to claim 1, wherein said resistive element is a spring.

7. The exercise device according to claim 1, where at least one handle is attached proximate said seat back.

8. A method of exercising abdominal and other muscles by using a device consisting essentially of:

a base, said base having a front end and a rear end;

a seat back having a top end and a bottom end, wherein said seat back is attached with a hinge to said base proximate the front end of said base and proximate the bottom end of said seat back, said base including a foot plate attached to said base proximate the lower front portion of said base;

a resistive element having a front end and a rear end, wherein the front end of said resistive element is attached proximate the bottom end of said seat back, and the rear end of said resistive element is attached proximate the rear end of said base, said resistive element adapted to allow backward pivoting movement of said seat back about said hinge when a user stands on said foot plate and presses in a backward direction against said seat back, said resistive element further adapted to provide substantially immediate and constant resistance upon movement of said seat back.

9. The exercise device according to claim 8, further comprising a resistive element adapted to allow forward pivoting movement of said seat back about said hinge after a uses presses in a backward direction against said seat back, and after said seat back has moved in a backward direction.

10. The exercise device according to claim 8, further comprising a resistive element adapted to increase its span between said seat back and said base.

11. The exercise device according to claim 8, further comprising a resistive element adapted to decrease its span between said seat back and said base.

12. The exercise device according to claim 10, further comprising a resistive element adapted to decrease its span between said seat back and said base.

13. The exercise device according to claim 8, wherein said resistive element is a spring.

14. The exercise device according to claim 8, where at least one handle is attached proximate said seat back.

15. The exercise device according to claim 1, wherein said seat back is substantially straight and occupies a single plane.

16. The exercise device according to claim 8, wherein said seat back is substantially straight and occupies a single plane.

* * * * *